United States Patent [19]

Stevenson

[11] Patent Number: 4,457,512

[45] Date of Patent: Jul. 3, 1984

[54] DEALING SHOE

[75] Inventor: Richard L. Stevenson, Minneapolis, Minn.

[73] Assignee: Jax, Ltd., Minneapolis, Minn.

[21] Appl. No.: 477,592

[22] Filed: Mar. 25, 1983

Related U.S. Application Data

[63] Continuation of Ser. No. 271,883, Jun. 9, 1981, abandoned.

[51] Int. Cl.[3] ..... A63F 1/14

[52] U.S. Cl. ..... 273/148 A; 211/51; 273/149 R

[58] Field of Search ..... 273/148 A, 149 R; 211/51, 52, 53, 54.1

[56] References Cited

U.S. PATENT DOCUMENTS

| | | | |
|---|---|---|---|
| 408,978 | 8/1889 | Jewell | 211/51 |
| 497,993 | 5/1893 | Thomson | 211/51 |
| 903,368 | 11/1908 | Flanders | 211/51 X |
| 2,912,113 | 11/1959 | Durec | 211/51 |
| 3,627,331 | 12/1971 | Erickson | 273/149 R |
| 3,929,339 | 12/1975 | Mattioli | 273/148 A |
| 3,979,119 | 9/1976 | Cecchetti | 46/25 |
| 4,019,743 | 4/1977 | Castanis | 273/241 |
| 4,126,962 | 8/1980 | Flemming | 273/426 |
| 4,310,160 | 1/1982 | Willette et al. | 273/149 R |

FOREIGN PATENT DOCUMENTS

| | | | |
|---|---|---|---|
| 530732 | 10/1921 | France | 273/148 A |

*Primary Examiner*—Anton O. Oechsle

*Attorney, Agent, or Firm*—Kenyon & Kenyon

[57] ABSTRACT

A dealing shoe for playing cards in the form of a box having a sloping front wall with a finger opening therein communicating with a slot horizontally disposed at a lower edge of the front wall for passage of cards therethrough. A downwardly inclined support plate is disposed within the box and slidably supports a pusher which serves to push the cards toward the front wall. Springs are employed to resiliently bias the pusher toward the front wall.

15 Claims, 4 Drawing Figures

DEALING SHOE

This application is a continuation of application Ser. No. 271,882, filed June 9, 1981, now abandoned.

BACKGROUND OF THE INVENTION

1. Field of the Invention

This invention relates to a device to hold playing cards in position to allow them to be dealt out one at a time. In particular, it relates to a device for holding a stack of cards tilted at an angle to a support and relatively loosely captured between a sloping front barrier and a resiliently biased pusher that urges the stack toward the front barrier to allow the cards to be dealt out one at a time through a slot along the lower edge of the front barrier as a result of finger pressure applied through an opening in the front barrier to allow finger engagement with the forwardmost card.

2. Prior Art

Various forms of card holders have been proposed heretofore for supporting a stack of cards or tickets in an enclosure that has a slot through which the cards can be ejected one at a time and an opening to allow frictional engagement with the forwardmost card to eject it through the slot by sliding it laterally with respect to the stack. Such a device is shown in U.S. Pat. No. 737,452 to Johnson in which the user's finger is pressed against the top card. A similar structure is shown in U.S. Pat. No. 3,185,482 by Russell. In both of these patents, the cards are directly vertically stacked in an enclosure to rest on a support resiliently urged against a top wall that has an opening through which pressure can be applied to the uppermost card to move it laterally through a side slot in a wall perpendicular to the plane of the cards.

U.S. Pat. No. 389,873 to Clark discloses another card dispenser in which a slide is pressed against one edge of the uppermost card held in a vertical stack in the dispenser to eject that card through a slot in a side wall perpendicular to the plane of the cards. Friedman et al., in U.S. Pat. No. 3,312,473, show a machine in which the bottom card is pushed off by a sliding feeder dog that engages the edge of the card. Both of these patents present the same possibility of undesired engagement between the cards and the edges of the pusher means. Such engagement could mar the edges of the cards.

U.S. Pat. No. 505,997 to Ward shows a tilted support for cards and resilient means to press the support and the cards resting on it against a bar that holds the cards in place. Although the cards are tilted, they are extracted one at a time by sliding them from under the bar and out into the open without having them pass through a slot.

U.S. Pat. No. 1,850,114 to McCaddin and U.S. Pat. No. 3,147,978 to Sjöstrand show machines with friction rollers to urge the top card off a deck. The cards, in each patent, are held in vertical alignment with each card lying flat on the card below it.

Mattioli in U.S. Pat. No. 3,929,339 describes a random dealing device in which a lower stack of cards is held tilted on a support and is urged against a front wall by a weight. The wall and the weight have similarly sloping surfaces that engage the surfaces of the tilted cards, and an upper, similarly tilted stack is held in place on the lower stack and supported by edge-to-edge engagement with cards in the lower stack. Friction rollers engage the forwardmost cards in both stacks through an opening in the front wall to draw cards from both stacks in random selection. The support on which the lower stack rests is sloped toward the front to allow the weight to respond to gravity in order to push the cards toward the front wall, and the support, with the cards and weight in it, is fitted into a tunnel in a pedestal that includes the rollers and means to rotate them. The pedestal also includes an outlet slot through which the randomly selected forwardmost cards emerge.

OBJECTS AND SUMMARY OF THE INVENTION

It is one of the objects of the present invention to provide a simple dealing shoe in which a stack of cards is held in tilted alignment on a support and urged toward a correspondingly sloping front wall by a pusher that has a correspondingly sloping forward surface and is resiliently urged toward the front wall to push a stack of cards along.

A further object is to provide a simplified dealing shoe that can be molded of plastic and easily assembled and which provides easy removal of the forwardmost card of a tilted stack by means of frictional finger engagement.

Further objects will be apparent from the following specification together with the drawings.

In accordance with the present invention a dealing shoe is constructed to have a support on which a stack of cards rests in a tilted position so that only the lower edge of the cards engages the support. The cards are tilted away from the front end of the support, and a barrier that slopes at a similar angle is arranged at the front end so that the cards can be pressed against it. The pressure is furnished by a pusher that slidingly engages the support and is resiliently biased toward the front barrier.

The support may be incorporated in a surrounding box that rests flat on a tabletop. The sides of the box constitute guides to hold the cards generally in alignment, and the front barrier is attached to the box and, together with the front end of the support, defines a slot through which the cards can emerge. The lower edge of the slot is formed by the front edge of the support. The front barrier has an opening that extends upwardly away from the slot and has sufficient width to allow finger pressure to be exerted on the forwardmost card to draw it downwardly toward and through the slot and thus to extract it from the stack within the dealing shoe. The support and the outer box may be connected to each other by fixed latches on one of the members to engage edges in the other member. To assist in holding the support in place, its front end may be wedge-shaped and forced into a space of approximately the same size within the outer box. The wedge-shaped front end has a rear surface that engages a forwardly directed edge of the box to help hold the support in place in the box.

In the preferred embodiment, tension springs under the support and within the box engage projections that extend downwardly from the ends of the pusher through guide slots that extend longitudinally along the support. Each of the slots is narrower than the ends of the projections that extend through them, so that with the support out of the outer box the outermost parts of the sides of the support must be spread away from the central portion in order to insert the projections, after which the sides can be allowed to spring back into place and the support forced into locking engagement with the outer box to hold the sides of the support firmly and prevent the sliding pusher from becoming disengaged from the slots. This structure also encloses the springs and the projections that extend through the slots, thereby preventing any interference with free movement of the pusher along the support.

DETAILED DESCRIPTION OF THE INVENTION

Figure 1:
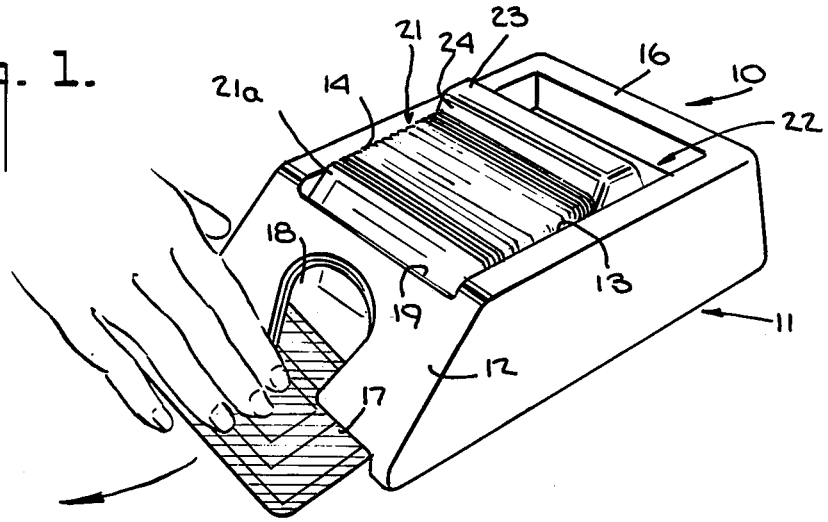
FIG. 1 is a perspective view of a dealing shoe constructed according to the present invention.

FIG. 1 shows a dealing shoe 10, the outer structure 11 of which constitutes partial enclosure means in the form of an open-top box that has a sloping front wall or barrier 12 and two sides 13 and 14 that form side guide means extending from the front wall 12 to a rear wall 16. At the lower edge of the front wall 12 is a card slot 17, and in the central part of the front wall is a finger opening 18 that communicates with the slot 17 and extends upwardly toward the upper edge 19 of the front wall.

A stack of cards 21 is supported on a support 22 within the outer structure 11. The cards are placed so that they stand on edge but not vertically. Instead, they are tilted back at an angle corresponding to the angle of the front wall 12, which provides a barrier against which the forwardmost card **21*a* is pressed by the cards behind it, which are in turn pushed by a pusher 23. The pusher slides on the support 22 and has a front surface 24 that slopes at the same angle as the cards 21 and the front barrier 12 so that the cards are held in surface-to-surface relationship between the rear surface of the front barrier 12 and the sloping front surface 24 of the pusher 23**.

Figure 2:
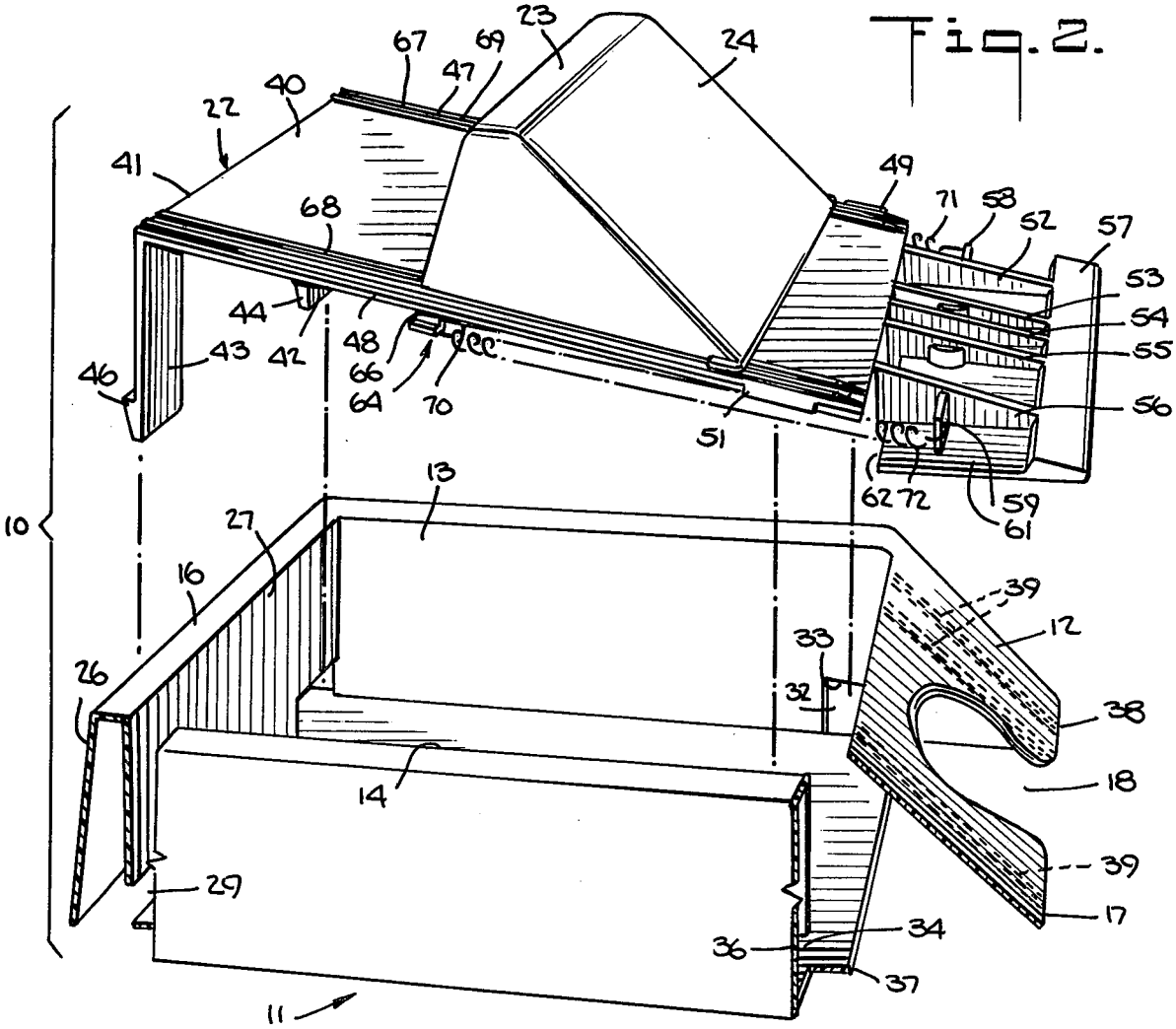
FIG. 2 is a perspective partially exploded view of the dealing shoe in FIG. 1.

FIG. 2 shows the dealing shoe 10 of FIG. 1 disassembled to illustrate the structure more clearly. In addition, parts of the outer structure 11 have been cut away to show the relationship between inner and outer portions of the structure. As may be seen by examination of the back wall 16, much of the structure 11 has inner and outer walls spaced apart. In the case of the back wall, the outer wall is identified by reference numeral 26 and the inner wall by reference numeral 27. There are two recesses, or cutout portions, 28 and 29 in the lower part of the inner wall 27 adjacent a flat base 31 that is substantially co-planar with the lower edge of both the outer and inner walls 26 and 27 and directly integrally joined to the latter.

The base 31 is also joined to lower edges of the side walls 13 and 14 which, together with the back wall 27, form three sides of an open-topped box. The walls 13 and 14 serve as guides for the edges of the cards 21 (FIG. 1). The side wall has a cutout 32 with an upper edge 33 that slopes at the same angle as the upper surface of the support 22, and the wall 14 has a corresponding, symmetrically positioned cutout 34 with a correspondingly sloping upper edge 36. The cutouts 32 and 34 are close to the front edge 37 of the base 31. This edge is spaced back from the forwardmost portion 38 of the sloping front barrier 12 to form the card slot 17. Several ridges 39 are formed on the rear surface of the front wall 12 to minimize contact between the forwardmost card **21*a* (FIG. 1**) and the front wall. This has the advantage of reducing friction between the front wall and the card and minimizing any wear on the card by the wall.

In this embodiment, the support 22 is formed as a separate structure from the outer box 21. The rear part of the support is a flat, smooth plate 40 that has a rear end 41 from which two arms 42 and 43 extend downwardly. Each of these arms has a latching means 44 and 46, respectively, at its lowermost end to engage the upper edges of the cutouts 28 and 29, respectively. Along the outermost side edges 47 and 48 of the plate 40 are two additional projections 49 and 51 to engage the upper edges 33 and 36 of the cutouts 32 and 34, respectively.

The forwardmost part of the support 22 comprises a series of vertical, triangular ribs 56–56, the upper edges of which form smooth continuations of the flat plate 40 along the same plane. At the front end of the support 22 is a smooth-topped member 57, the upper surface of which is a continuation in the same plane as the upper surface of the plate 40 and the upper edges of the ribs 52–56. The member 57 extends into the lower part of the slot 17 and may even extend slightly beyond the front end 38 of the outer structure 11 so that pressure even imposed vertically downwardly through the finger opening 18 on the forwardmost card will be divided into a downward force and a forward force on that card, bending the card just enough to allow it to emerge smoothly from the shoe.

The support 22 also includes a pair of projections 58 and 59 extending outwardly from the ribs 52 and 56, respectively, but not as far out as the outermost edges of the member 57 and below the upper surfaces of the ribs 52–56. Beneath the ribs 52–56 and the projections 58 and 59 is a flat plate 61 that has a rear edge 62 that abuts the forward edge 37 of the base 31 when the card support 22 is assembled with the outer structure 11. After these parts have been so assembled, the support 22 is firmly but releasably retained in place in the outer structure 11 by engagement of the latches 44 and 46 with the edges of the openings 28 and 29 and engagement of the latches 49 and 51 with the sloping edges 33 and 36 of the openings 32 and 34 and by engagement of the edge 62 with the edge 37. In order to reach such a state of assembly, it is necessary that the arms 43 and 42 bend resiliently inwardly far enough to allow the latches 44 and 46 to pass by the solid portion of the inner wall 27 to reach the openings 28 and 29, and it is also necessary for one or the other or both of the walls 13 and 14 to spread outwardly resiliently far enough to allow passage of the latches 49 and 51 into the openings 32 and 34, respectively.

Figure 3:
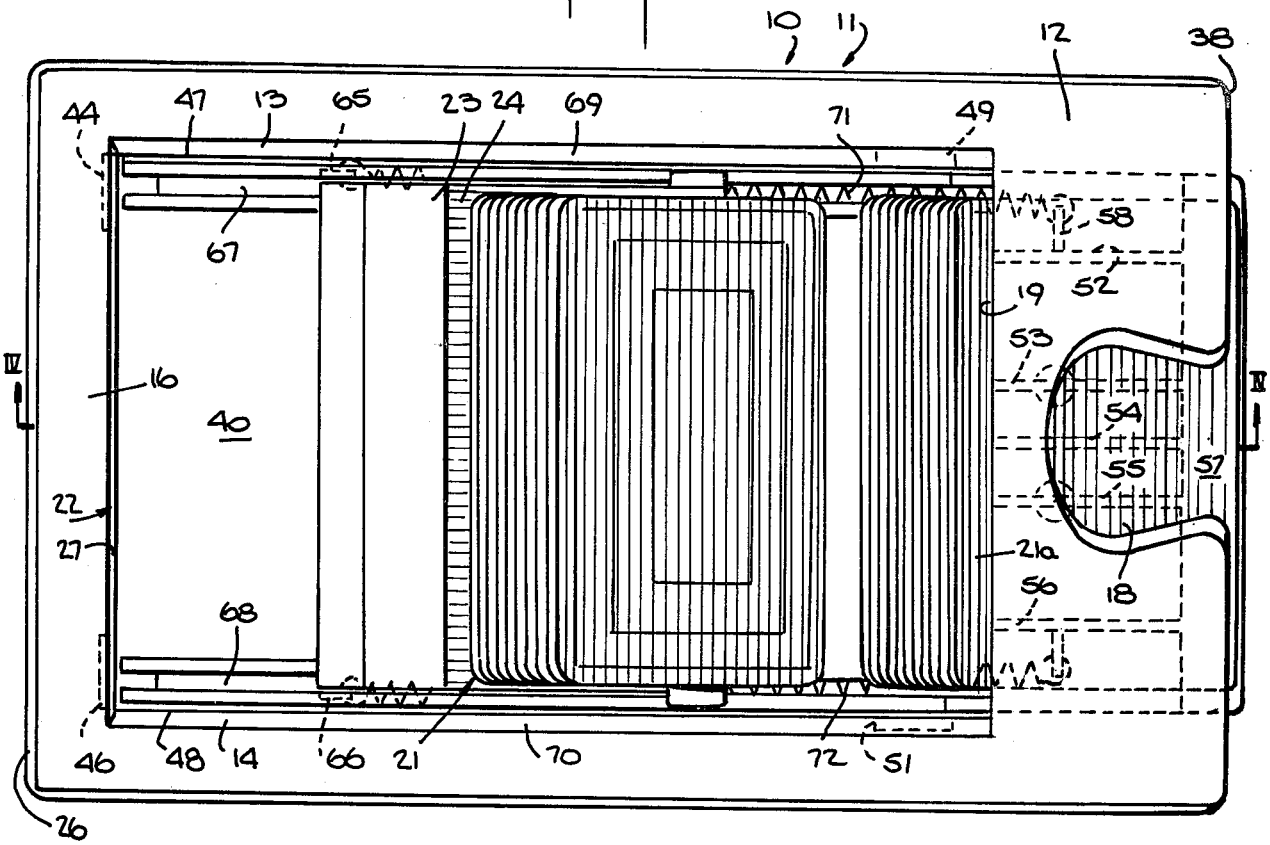
FIG. 3 is a plan view of the dealing shoe in FIG. 1.

However, prior to assembly of the card support 22 with the outer structure 11, the pusher 23 must be interconnected with the card support. The pusher 23 has a pair of projections 63 and 64 which cooperate with a pair of guide slots 67 and 68 each closed at both ends, in the plate 40 to guide the sliding movement of the pusher against the cards. The projection 64 is symmetrical with the other projection 63 at the other side of the pusher where it cannot be seen in FIG. 2 but can be seen in FIG. 4. The projection 63 includes an outwardly extending flange 65, as shown in FIG. 3, so that the total width of the projection 63 below the plate 40 is wider than the guide slot 67 through which that projection extends. A similar flange 66 extends outwardly from the porjection 64 to make that projection wider than the guide slot 68 through which that projection extends. The guide slots 67 and 68 receive and guide the projections 63 and 64 and thereby guide the pusher 23. At the same time, the limited width of the slots prevents the pusher 23 from being removed accidentally from sliding engagement with the support 22.

In order to assemble the pusher 23 with the support 22, portions 69 and 70 of the outermost side parts of the support 22 adjacent the edges 48 and 47 respectively define bendable rails which are resilient enough to be pulled away from the central part of the support 22 sufficiently to allow the flange 65 and the flange 66 to enter the slots 67 and 68, respectively. Once this has happened, the portions 69 and 70 may be released so that they will spring back into the position illustrated in FIG. 2, thereby closing the slots 67 and 68 sufficiently to releasably retain the projection 64 and the unseen projection at the other side of the pusher 23 firmly but slidably in place. The overall width of the support 22 between the edges 47 and 48 is sufficient to fill the lateral space between the walls 13 and 14 of the outer structure 11 when the support 22 has been inserted into the outer structure. Thus, the portions 69 and 70 connot be spread apart far enough to allow the projections 63 and 64 from becoming separated from the slots 67 and 68 when the dealing shoe is in use.

In addition to holding the pusher 23 firmly but slidably assembled on the plate 40 of the support 22, the projections 63 and 64 are connected by tension springs 71 and 72, respectively, to the projections 58 and 59 to provide resilient bias that pulls the pusher 23 toward the front of the support 22 and thus applies pressure to the stack of cards 21 in FIG. 1 to press the forwardmost card 21*a* against the inwardly facing surfaces of the ridges 39.

FIG. 3 illustrates the way the cards 21 fit into the dealing shoe 10 so that they rest on the support 22 within the outer structure 11. Specifically, the cards are held between the front surface 24 of the pusher 23 and the rear surface of the front barrier 12, in the fore and aft direction, and they are somewhat loosely held between the walls 13 and 14 in the transverse direction. As may be seen, the front edge of the member 57 extends slightly beyond the front end 38 of the outer box 11.

Figure 4:
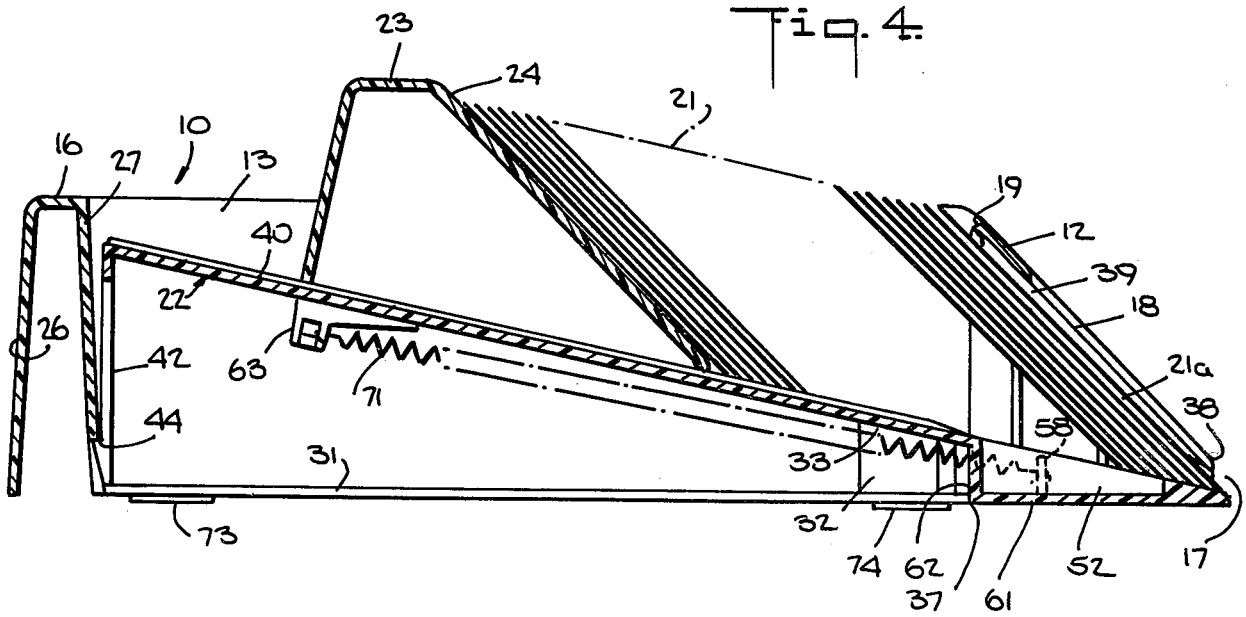
FIG. 4 is a cross-sectional side elevational view of the dealing shoe in FIG. 1.

FIG. 4 is a cross-sectional view that illustrates the dealing shoe 10, the arrangement of the support 22 in the outer box 11 and the way the cards 21 are stacked on the support 22. The shoe 10 is supported on feet at the corners of the base 31, only two of which feet 73 and 74 are shown. The finger opening 18 extends far enough up the front barrier 12 to allow finger pressure to be exerted on the forwardmost card 21*a* above the center thereof. Frictional pressure on this card, whether directly downward or both downward and outward, causes the card 21*a* to slide downwardly and to curve outwardly through the slot 17 and across the front edge of the member 57 to be dealt out from the rest of the stack of cards 21.

In order for the cards 21 to move smoothly across the surface of the support 22 and the ridges 39, and even the surface 24 in the case of the last card in the stack 21, it is desirable that the surfaces contacted by the cards be smooth. For this purpose, and in order to provide the desired resilience to allow the support 22 to be pressed into engagement with the outer structure 11 and to allow the portions 69 and 70 to be spread out enough for the flanges 65 and 66 to pass through, the structure 11, the support 22 and the pusher 23 should be manufactured of a material that has the necessary resilience and is capable of being prepared with a surface over which the cards can slide smoothly. In the preferred embodiment, plastics with suitable lubricants, such as high impact polystyrene polymerized with between about 2 and 5% of a plastics lubricant, are preferably employed.

While this invention has been described in terms of a specific preferred embodiment, it will be understood by those skilled in the art that modifications may be made therein within the scope of the following claims.

What is claimed is:

1. A dealing shoe for playing cards comprising:

a box having a sloping front wall with a finger opening therein communicating with a slot horizontally disposed at a lower edge of said front wall for passage of cards therethrough;

a support disposed in said box, said support having a flat plate with closed guide slots extending from a front end of said flat plate to a rear end of said flat plate to define a bendable rail along each respective slot, said flat plate extending downwardly from said rear wall of said box towards said front wall;

a pusher slidably mounted on said support, said pusher having a sloping front surface and projections extending through said guide slots in said flat plate, each projection having a width below said flat plate greater than a width of a respective guide slot for releasably retaining said pusher on said support; and means for resiliently biasing said pusher toward said front wall of said box.

2. A dealing shoe for playing cards comprising:

a box having a sloping front wall with a finger opening therein communicating with a slot horizontally disposed at a lower edge of said front wall for passage of cards therethrough;

a support disposed in said box, said support having a flat plate with guide slots extending from a front end of said flat plate to a rear end of said flat plate, said flat plate extending downwardly from said rear wall of said box towards said front wall;

a pusher slidably mounted on said support, said pusher having a sloping front surface and projections extending through said guide slots in said flat plate, each projection having a width below said flat plate greater than a width of a respective guide slot for retaining said pusher on said support; and means for resiliently biasing said pusher toward said front wall of said box;

wherein said box includes at least one recess in a rear wall thereof and said support includes at least one arm extending downwardly from said rear end and having a latching means releasably retained in said recess.

3. A dealing shoe in accordance with claim 1 wherein each of said guide slots is disposed adjacent an outermost side edge of said flat plate and penetrates through said flat plate to define a resilient portion thereat to permit passage of a respective projection through said respective guide slot.

4. A dealing shoe in accordance with claim 1 wherein said box includes at least one cutout in a side wall thereof and said support includes at least one projection along an outermost side edge thereof releasably retained in said cutout.

5. A dealing shoe for playing cards comprising:

a box having a sloping front wall with a finger opening wherein communicating with a slot horizontally disposed at a lower edge of said front wall for passage of cards therethrough;

a support disposed in said box, said support having a flat plate with guide slots extending from a front end of said flat plate to a rear end of said flat plate, said flat plate extending downwardly from said rear wall of said box towards said front wall; a series of vertical triangular ribs extending from said plate at a forwardmost part of said plate; and a smooth-topped member at an opposite end of said ribs from said plate extending into said slot of said box;

a pusher slidably mounted on said support, said pusher having a sloping front surface and projections extending through said guide slots in said first plate, each projection having a width below said flat plate greater than a width of a respective guide slot for retaining said pusher on said support; and means for resiliently biasing said pusher toward said front wall of said box.

6. A dealing shoe for playing cards comprising:

a box having a sloping front wall with a finger opening therein communicating with a slot horizontally disposed at a lower edge of said front wall for passage of cards therethrough; wherein said front wall of said box includes ridges on a rear surface thereof for minimizing contact between a forwardmost card and said front wall;

a support disposed in said box, said support having a flat plate with guide slots extending from a front end of said flat plate to a rear end of said flat plate, said flat plate extending downwardly from said rear wall of said box towards said front wall;

a pusher slidably mounted on said support, said pusher having a sloping front surface and projections extending through said guide slots in said flap plate, each projection having a width below said flat plate greater than a width of a respective guide slot for retaining said pusher on said support; and means for resiliently biasing said pusher toward said front wall of said box.

7. A dealing shoe in accordance with claim 1 wherein said means for resiliently biasing said pusher comprises at least one tension spring under said support and within said box, an end of said tension spring engaging a bottom part of a respective projection on said pusher beneath said plate.

8. A dealing shoe for cards comprising:

a plastic box defining a cavity for a stack of cards and having a sloping front wall with a horizontally disposed slot at a lower edge communicating with said cavity for passage of a card therethrough;

an inclined plastic support disposed in said box, said support having a flat member having closed guide slots therein extending from a front to a rear of said flat member to define a bendable rail along each respective slot;

a plastic pusher slidably mounted on said support, said pusher having a sloping front surface for engaging a stack of cards in said cavity, and projections extending through said guide slots wherein the width of said projections below said flat member is greater than that of said guide slots for releasably retaining said pusher on said support; and means for resiliently biasing said pusher toward said front wall of said box.

9. A dealing shoe in accordance with claim 9 wherein each of said guide slots is disposed adjacent an outermost side edge of said flat member and penetrates through said flat member to define a resilient portion thereat to permit passage of a respective projection through said respective guide slot.

10. A dealing shoe in accordance with claim 8 wherein said box includes at least one cutout in a side wall thereof and said support includes at least one projection along an outermost side edge thereof releasably retained in said cutout.

11. A dealing shoe in accordance with claim 8 wherein said box, said support and said pusher are molded plastic.

12. A dealing shoe for cards comprising:

a plastic box defining a cavity for a stack of cards and having a sloping front wall with a horizontally disposed slot at a lower edge communicating with said cavity for passage of a card therethrough;

an inclined plastic support disposed in said box, said support having a flat member having guide slots therein extending from a front to a rear of said flat member;

a plastic pusher slidably mounted on said support said pusher having a sloping front surface for engaging a stack of cards in said cavity, and projections extending through said guide slots wherein the width of said projections below said flat member is greater than that of said guide slots; and means for resiliently biasing said pusher toward said front wall of said box;

wherein said plastic box includes at least one recess in a rear wall thereof and said plastic support includes at least one arm extending downwardly from said rear having latching means releasably retained in said recess.

13. A dealing shoe for cards comprising:

a plastic box defining a cavity for a stack of cards and having a sloping front wall with a horizontally disposed slot at a lower edge communicating with said cavity for passage of a card therethrough;

an inclined plastic support disposed in said box, said support having a flat member having guide slots therein extending from a front to a rear of said flat member; a series of vertical, triangular ribs extending from said flat member at a forwardmost part of said flat member; and a smooth-topped member at an opposite end of said ribs from said flat member extending into said slot of said box;

a plastic pusher slidably mounted on said support, said pusher having a sloping front surface for engaging a stack of cards in said cavity, and projections extending through said guide slots wherein the width of said projections below said flat member is greater than that of said guide slots; and means for resiliently biasing said pusher toward said front wall of said box.

14. A dealing shoe for cards comprising:

a plastic box defining a cavity for a stack of cards and having a sloping front wall with a horizontally disposed slot at a lower edge communicating with said cavity for passage of a card therethrough, wherein said front wall of said box includes ridges on a rear surface thereof for minimizing contact between a forwardmost card and said front wall;

an inclined plastic support disposed in said box, said support having a flat member having guide slots therein extending from a front to a rear of said flat member;

a plastic pusher slidably mounted on said support, said pusher having a sloping front surface for engaging a stack of cards in said cavity, and projections extending through said guide slots wherein the width of said projections below said flat member is greater than that of said guide slots; and means for resiliently biasing said pusher toward said front wall of said box.

15. A dealing shoe for cards comprising:

a plastic box defining a cavity for a stack of cards and having a sloping front wall with a horizontally disposed slot at a lower edge communicating with said cavity for passage of a card therethrough;

an inclined plastic support disposed in said box, said support having a flat member having guide slots therein extending from a front to a rear of said flat member;

a plastic pusher slidably mounted on said support, said pusher having a sloping front surface for engaging a stack of cards in said cavity, and projections extendig through said guide slots wherein the width of said projections below said flat member is greater than that of said guide slots; and means for resiliently biasing said pusher toward said front wall of said box;

wherein said box, said support and said pusher are lubricant-containing plastic.

* * * * *

UNITED STATES PATENT AND TRADEMARK OFFICE

CERTIFICATE OF CORRECTION

PATENT NO. : 4,457,512

DATED : July 3, 1984

INVENTOR(S) : Richard L. Stevenson

It is certified that error appears in the above-identified patent and that said Letters Patent is hereby corrected as shown below:

Col. 4, line 17, delete "56-56" and insert --52-56--.

Col. 4, line 68, delete "porjection" and insert --projection--.

Col. 5, line 23, delete "connot" and insert --cannot--.

Col. 6, line 68, delete "wherein" and insert --therein--.

Col. 7, line 15, delete "first" and insert --flat--.

Col. 7, line 68, delete "claim 9" and insert --claim 8--.

Signed and Sealed this

*Thirtieth* Day of *October 1984*

[SEAL]

*Attest:*

GERALD J. MOSSINGHOFF

*Attesting Officer*

*Commissioner of Patents and Trademarks*